US010870194B1

(12) United States Patent
Semler

(10) Patent No.: US 10,870,194 B1
(45) Date of Patent: Dec. 22, 2020

(54) VEHICLE MULTI-TOOL

(71) Applicant: John E. Semler, Reno, NV (US)

(72) Inventor: John E. Semler, Reno, NV (US)

( * ) Notice: Subject to any disclaimer, the term of this patent is extended or adjusted under 35 U.S.C. 154(b) by 0 days.

(21) Appl. No.: 16/438,778

(22) Filed: Jun. 12, 2019

(51) Int. Cl.
*B25F 1/00* (2006.01)

(52) U.S. Cl.
CPC ..... *B25F 1/006* (2013.01)

(58) Field of Classification Search
CPC ..... B25F 1/006; A62B 3/00; A62B 3/005; B60D 1/58; B25D 1/04
See application file for complete search history.

(56) References Cited

U.S. PATENT DOCUMENTS

| | | | | |
|---|---|---|---|---|
| 738,753 | A * | 9/1903 | Baggett | B25D 1/04 254/26 R |
| 3,821,824 | A * | 7/1974 | Pilcher | B25D 1/00 7/143 |
| 5,344,201 | A | 9/1994 | Offin | |
| D370,605 | S | 6/1996 | Schimeneck et al. | |
| 5,970,552 | A * | 10/1999 | Kwiecien | B25B 13/461 7/138 |
| 7,159,260 | B2 | 1/2007 | Hansen | |
| D566,495 | S | 4/2008 | Hackmann | |
| 7,634,830 | B2 * | 12/2009 | Ryan | A62B 3/00 7/138 |
| 7,673,912 | B2 * | 3/2010 | Breininger | B25B 9/00 294/210 |
| 7,774,882 | B2 * | 8/2010 | Liou | B25F 1/00 254/18 |
| 8,210,584 | B2 | 7/2012 | Hiltz | |
| 9,003,586 | B2 * | 4/2015 | Weddle | B25F 1/00 7/166 |
| 9,345,912 | B2 * | 5/2016 | Wells | B25F 1/006 |
| 9,656,379 | B2 * | 5/2017 | Doster, Jr. | B25F 1/006 |
| 9,844,989 | B2 | 12/2017 | Wilson | |
| 9,902,055 | B1 * | 2/2018 | Baker | B25F 1/006 |
| 2006/0043746 | A1 | 3/2006 | Theobald | |
| 2016/0243691 | A1 * | 8/2016 | Nicholls | B25F 1/006 |
| 2017/0043468 | A1 | 2/2017 | Wade | |

* cited by examiner

*Primary Examiner* — David B. Thomas
(74) *Attorney, Agent, or Firm* — Cramer Patent & Design PLLC; Aaron R. Cramer

(57) ABSTRACT

A vehicle multi-tool includes a tire hammer at a first end, a chain tightener at a central point, a fifth wheel puller hook at a second end and a chain latch and trailer valve helper adjacent the fifth wheel puller hook.

20 Claims, 3 Drawing Sheets

VEHICLE MULTI-TOOL

FIELD OF THE INVENTION

The presently disclosed subject matter is directed to vehicle tools. More particularly, it is directed to vehicle service tools having multiple tools integrated into one.

BACKGROUND OF THE INVENTION

Modern America relies on numerous types of transportation vehicles such as cars, motorcycles, ambulances, vans, trucks and semi-trucks. These vehicles are often used on a daily basis to transport people and goods from where they are to where they are needed.

All transportation vehicles have one thing in common, they are mechanical devices. As such they are subject to wear and tear, breakdowns, and maintenance requirements. For example, semi-tractor trailers use a so-called fifth wheel to attach the trailer to the tractor. Such fifth wheels use a latch assembly to ensure that the tractor and the trailer are safely attached. To disengage the trailer from the tractor a trucker often uses a hook to grab a latch arm to release the fifth wheel kingpin which then allows separation.

In addition, when hauling loads truckers often use chains to secure their load to their truck bed. Very often steel rods having chiseled ends are used to assist tightening the chains, and then to release them once they are installed. Another task that often has to be performed is the engagement and turning of trailer valves.

Other common tasks associated with transportation vehicles relate to wheel maintenance. For example, it is relatively common for the tires of a transportation vehicle to pick up nails, screws, or other sharp objects. Such foreign objects have to be removed, and that often requires a tool to grab the foreign objects and to supply a mechanical advantage to assist removing such objects. Another maintenance issue associated with tires is their air pressure. Many truckers use a hammer or other blunt object to strike their tires to ensure that they have sufficient air pressure and thus are not "flat."

Accordingly, tools which can perform maintenance and operational services to transportation vehicles would be beneficial. To save space and to keep a needed tool at hand, beneficially such tools would perform multiple tasks. Preferably such multi-use tools would be suitable for being made available at low cost and would be both intuitive and safe to use.

SUMMARY OF THE INVENTION

The principles of the present invention provide for multiple-use tools which can perform maintenance and operational services to transportation vehicles. Such tools can perform multiple tasks in a safe, intuitive manner and are suitable for being made available at low cost.

A vehicle multi-tool in accord with the present invention includes an elongated cylindrical first bar having a first bar chiseled end, and an elongated cylindrical second bar that extends from an intermediate point of the first bar. The second bar is shorter than the first bar and has a second bar chiseled end.

That vehicle multi-tool may have a first bar chiseled end with a blunted edge, and that blunted edge may have a "V" shaped notch. In practice, the second bar chiseled end is orientated ninety degrees (90°) from the plane of the first bar chiseled end. In addition, the second bar chiseled end may be thicker than the first bar chiseled end. There also may be a hook that is affixed to the first bar. If so, that hook may be orientated ninety degrees (90°) from the second bar. In any event that vehicle multi-tool can include a hammer that is affixed to an end of the first bar. Beneficially, that hammer is comprised of square bar stock. In addition, that vehicle multi-tool may include a first grip that encompasses a majority of the outer surface of the first bar between the hammer and the second bar. There can also be a second grip which encompasses a majority of the outer surface between the second bar and the hook.

An alternative vehicle multi-tool may include an elongated cylindrical first bar having a first chiseled end at one end and a hammer at the second end. Also included is an elongated cylindrical second bar which is shorter than the first bar. That second bar has a second chiseled end.

In that alternative vehicle multi-tool, the first chiseled end may have a first blunted edge, preferably with a "V" shaped notch. The second chiseled end is orientated ninety degrees (90°) from the plane of the first bar. In practice the second chiseled end is thicker than the first chiseled end. Also included can be a hook that is affixed to the first bar. If so, that hook is beneficially orientated ninety degrees (90°) from the second bar.

In yet another vehicle multi-tool that is in accord with the present invention there is an elongated cylindrical first bar having a first chiseled end with a "V"-shaped notch, a hammer at the second end, and a hook that is adjacent to the first chiseled end. Also included is an elongated cylindrical second bar which is shorter than the first bar. That second bar perpendicularly extends from an intermediate location of the first bar and has a second chiseled end.

With that alternative vehicle multi-tool, the first and the second chiseled ends may have blunted edges and the hammer may be square bar stock.

BRIEF DESCRIPTION OF THE DRAWINGS

The advantages and features of the present invention will become better understood with reference to the following detailed description and claims when taken in conjunction with the accompanying drawings, in which like elements are identified with like symbols, and in which:

DESCRIPTIVE KEY

Figure 1:
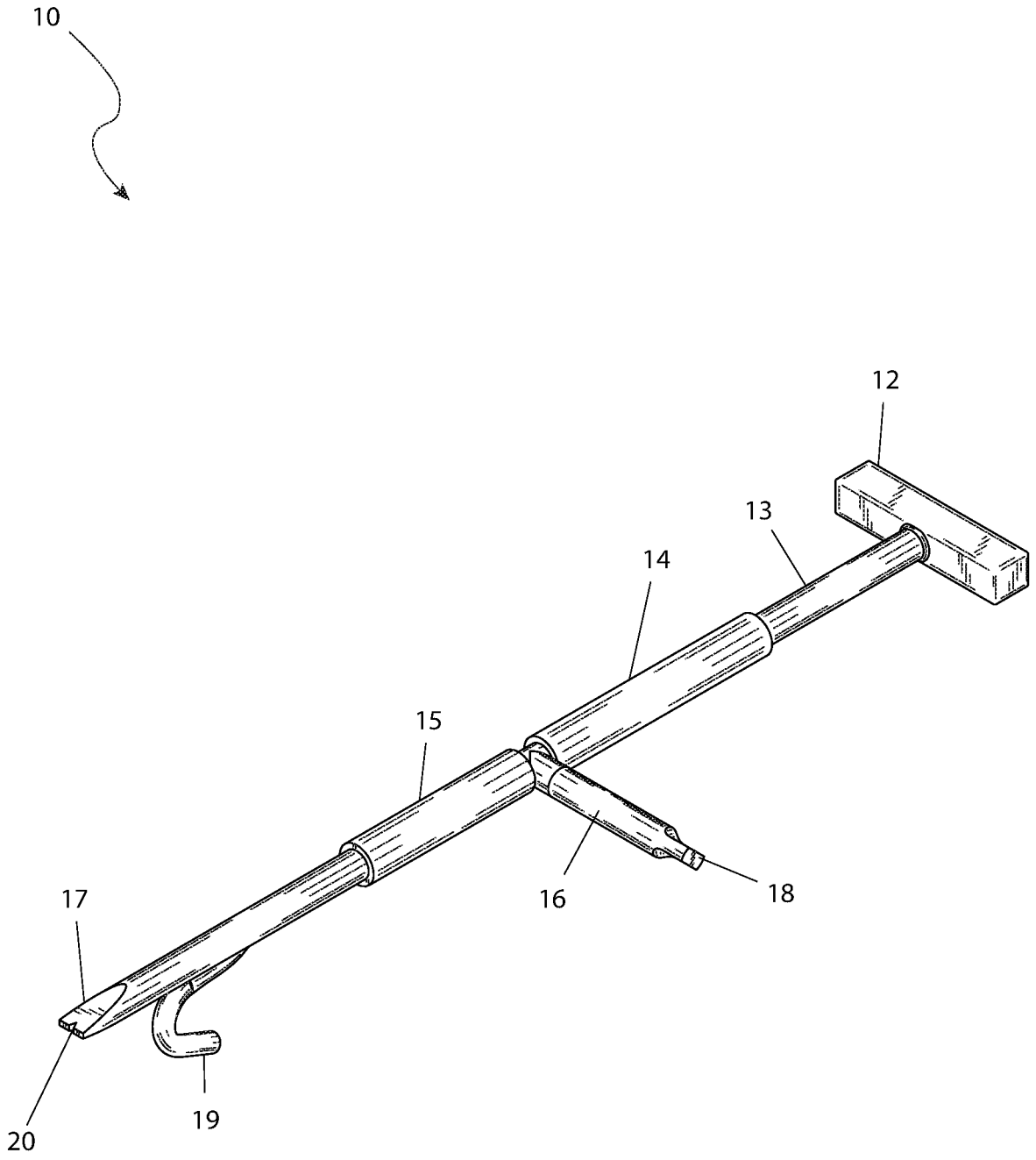
FIG. 1 is a perspective view of a vehicle multi-tool 10 that is in accord with the preferred embodiment of the present invention.

10 vehicle multi-tool
12 hammer
13 first bar
14 first grip
15 second grip
16 second bar
17 first chiseled end
18 second chiseled end
19 hook
20 "V"-notch
23 hook sleeve

1. Description of the Invention

Figure 2:
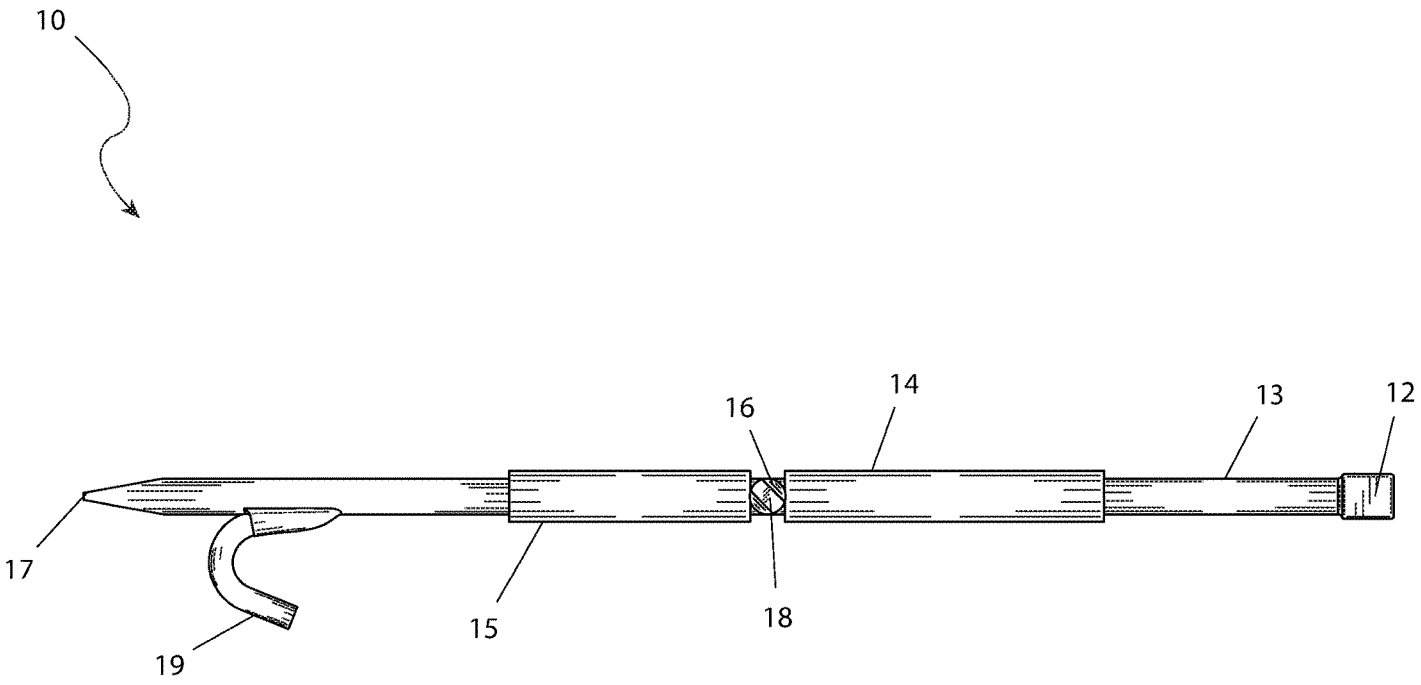
FIG. 2 is a side elevation view of the vehicle multi-tool 10 shown in FIG. 1; and, FIG. 3 is a top plan view of the vehicle multi-tool 10 shown in FIGS. 1 and 2.
Figure 3:
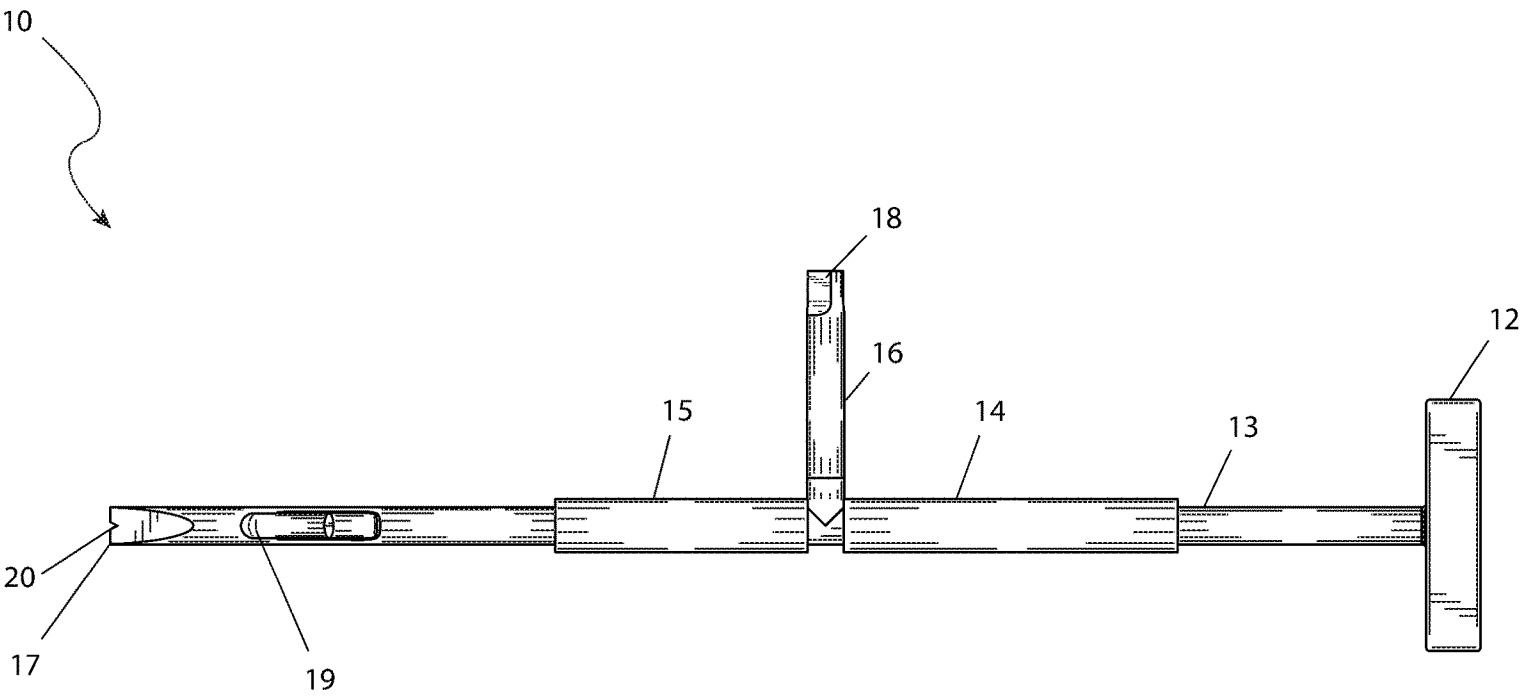

The preferred embodiment of the present invention is depicted in FIGS. 1 through 3. However, the invention is not limited to the specifically described embodiment. A person skilled in the art will appreciate that many other embodiments of the invention are possible without deviating from the basic concept of the invention. Any such work around will also fall under the scope of this invention.

The terms "a" and "an" as used herein do not denote a limitation of quantity, but rather denote the presence of at least one of the referenced items.

Referring to the Figures, the present invention relates to vehicle multi-tools 10 which can accomplish a myriad of tasks of the type commonly required in trucks, semi-tractors and trailers, automobiles, van, and other transportation vehicles.

As shown in the Figures, the vehicle multi-tool 10 comprises an elongated cylindrical first bar 13 having a first end and a second end, and a much shorter elongated cylindrical second bar 16 that extends perpendicularly from an intermediate location of the first bar 16. The first bar 13 and the second bar 16 can be formed or forged as a unitary structure or the second bar 16 may be affixed to the first bar 13 by a connector or by welding.

The first end of the first bar 13 terminates in a first chiseled end 17. Preferably the first chiseled end 17 has a blunted edge. As such, the first chiseled end 17 is well-suited for engaging with chain latches of the type used with trailer load-securing chains. The first chiseled end 17 is also well suited for engaging trailer valves.

As best shown in FIGS. 1 and 3, the blunted edge of the first chiseled end 17 has a "V" shaped-notch 20. That notch 20, along with the general shape of the first chiseled end 17, provide a catch and a fulcrum that are useful for removing nails or a similar elements such as may find their way into a tire. In a preferred embodiment, the notch 20 extends inward at a distance of one-eighth of an inch (⅛ in.).

The free end of the second bar 16 terminates in a second chiseled end 18 that is similar to the first chiseled end 17. However, the second chiseled end 18 is orientated ninety degrees (90°) from the plane of the first chiseled end 17. That orientation improves the handling of the vehicle multi-tool 10 when attempting to fit the second chiseled end 18 into a slotted feature.

In addition, the second chiseled end 18 is shorter and thicker than the first chiseled end 17. The shorter and thicker second chiseled end 18 is well suited for chain tightening. A great mechanical advantage is provided by locating the second bar 16 at about the middle of the longer first bar 13. Having a thicker body enables the second bar 16 to apply much greater torque to the chains while the shorter body enables easier manipulation of that second bar 16.

As best shown in FIGS. 1 and 2, near the first chiseled end 17 is a hook 19. The hook 19 is affixed via welding or other means to the first bar 13 such that the hook 19 is orientated ninety degrees (90°) from the second bar 16. That moves the plane of the hook 19 out of the plane of the second bar 16 which tends to improve device clearances with external objects when either the hook 19 or the second bar 16 is in use.

The hook 19 curves backwards towards the first end of the first bar 13. While the hook 19 may be simply affixed to the first bar 13, additional structural strength can be imparted by including a hook sleeve 23 that is affixed to the first bar 13 and to the hook 19 where that hook 19 is welded to the first bar 13. While the hook 19 has a multitude of uses it is particularly beneficial as a fifth wheel puller.

As shown in FIGS. 1-3, a hammer 12 is affixed to the second end of the first bar 13. While the hammer 12 may take many forms it is beneficially comprised of square bar stock that is attached at its center point to the first bar 13. The hammer 12 can be beneficially used to thump the tires. Square bar stock beneficially results in two hammer heads for thumping tires without harm while also enabling the vehicle multi-tool 10 to lie flat.

The first bar 13 further includes a first grip 14 that encompasses a majority of the outer surface of the first bar 13 between the hammer 12 and the second bar 16. In addition, there is a second grip 15 that is substantially identical to the first grip 14 but encompasses a majority of the outer surface of the first bar 13 between the second bar 16 and the hook 19. The first and second grips 14, 15 provide ergonomic handles on the vehicle multi-tool 10.

In an exemplary embodiment, the hammer 12, the hook 19, the first bar 13, and the second bar 16 are all manufactured out of cold-rolled steel. However, annealing or other heat treatment may be useful in some applications. In addition, the use of stainless steel, a synthetic material, or organic materials may also be used. However, whatever material is used should provide resiliency, inertness, water- and weather-proof abilities.

In an exemplary embodiment the hammer 12 is square bar stock having a length of four inches (4 in.) and a thickness of three-quarters of an inch (¾). The first bar 13 and the second bar 16 are beneficially cylindrical bar stock (save for the flattened portions 17, 18) of three-quarters of an inch (¾) in diameter. The first bar 13 has a length of twenty and one-quarter inches (20¼ in.). Thus, when accounting for the thickness of the hammer 12, the overall length of the vehicle multi-tool 10 is twenty-one inches (12 in.). The length of the second bar 16 is three and one-half inches (3½ in.). The attachment point of the second bar 13 to the first bar 13 is approximately ten and one-half inches (10½ in.) from the hammer 12. The forward-most curve of the hook 12 is approximately two inches (2 in.) from the terminal end of the second end of the first bar 13. The first grip 14 and second grip 15 are each preferably a vinyl tubing having an inner diameter capable of gripping onto the circumferential outer surface of the first bar 13. The first grip 14 has a length of six inches (6 in.) and the second grip 15 has a length of four and one-half inches (4½ in.). It is appreciated that different sizes for the vehicle multi-tool 10 can be appreciated as falling under the scope of the present invention.

The foregoing descriptions of a specific embodiment of the present invention have been presented for purposes of illustration and description. They are not intended to be exhaustive or to limit the invention to the precise forms disclosed. Obviously, many modifications and variations are possible in light of the above teaching. The embodiment was chosen and described in order to best explain the principles of the invention and its practical application, to thereby enable others skilled in the art to best utilize the invention and various embodiments with various modifications as are suited to the particular use contemplated.

What is claimed is:

1. A vehicle multi-tool, comprising:

an elongated cylindrical first bar having a first bar chiseled end; and an elongated cylindrical second bar extending from an intermediate location of said first bar, said second bar being shorter than said first bar and has a second bar chiseled end.

2. The vehicle multi-tool according to claim 1, wherein said first bar chiseled end has a blunted edge.

3. The vehicle multi-tool to according to claim 2, wherein said blunted edge has a "V" shaped notch.

4. The vehicle multi-tool to according to claim 2, wherein said second bar chiseled end is orientated ninety degrees (90°) from the plane of said first bar chiseled end.

5. The vehicle multi-tool to according to claim 4, wherein said second bar chiseled end is thicker than said first bar chiseled end.

6. The vehicle multi-tool to according to claim 5, further including a hook affixed to said first bar.

7. The vehicle multi-tool to according to claim 6, wherein said hook is orientated ninety degrees (90°) from said second bar.

8. The vehicle multi-tool to according to claim 7, further including a hammer affixed to an end of said first bar.

9. The vehicle multi-tool to according to claim 8, wherein said hammer is comprised of square bar stock.

10. The vehicle multi-tool to according to claim 8, further including a first grip that encompasses a majority of the outer surface of said first bar between said hammer and said second bar, and a second grip which encompasses a majority of said outer surface between said second bar and said hook.

11. A vehicle multi-tool assembly, comprising:

an elongated cylindrical first bar having a first chiseled end at one end and a hammer at the second end; and, an elongated cylindrical second bar which is shorter than said first bar, said second bar having a second chiseled end.

12. The vehicle multi-tool according to claim 11, wherein said first chiseled end has a first blunted edge.

13. The vehicle multi-tool to according to claim 12, wherein said first blunted edge has a "V" shaped notch.

14. The vehicle multi-tool to according to claim 12, wherein said second chiseled end is orientated ninety degrees (90°) from the plane of said first bar.

15. The vehicle multi-tool to according to claim 14, wherein said second chiseled end is thicker than said first chiseled end.

16. The vehicle multi-tool to according to claim 15, further including a hook affixed to said first bar.

17. The vehicle multi-tool to according to claim 16, wherein said hook is orientated ninety degrees (90°) from said second bar.

18. A vehicle multi-tool assembly, comprising:

an elongated cylindrical first bar having a first chiseled end with a "V"-shaped notch, a hammer at the second end, and a hook adjacent said first chiseled end; and an elongated cylindrical second bar which is shorter than said first bar, said second bar perpendicularly extending from an intermediate location of said first bar, said second bar having a second chiseled end.

19. The vehicle multi-tool according to claim 18, wherein said first and said second chiseled ends have blunted edges.

20. The vehicle multi-tool to according to claim 18, wherein said hammer is comprised of square bar stock.

* * * * *